United States Patent [19]

Tominaga et al.

[11] Patent Number: 4,731,040

[45] Date of Patent: Mar. 15, 1988

[54] METHOD AND APPARATUS FOR MANUFACTURING CATHODE RAY TUBE

[75] Inventors: Fujio Tominaga, Himeji; Akihiro Hayashi, Tatsuno; Yasunori Minamoto, Yokohama, all of Japan

[73] Assignee: Kabushiki Kaisha Toshiba, Kawasaki, Japan

[21] Appl. No.: 945,526

[22] Filed: Dec. 23, 1986

[30] Foreign Application Priority Data

Dec. 26, 1985 [JP] Japan ..... 60-294375

[51] Int. Cl.[4] ..... H01J 9/26

[52] U.S. Cl. ..... 445/45; 65/36; 65/155; 65/271; 445/66; 445/70; 432/225

[58] Field of Search ..... 445/45, 66, 70; 65/36, 65/57, 155, 271

[56] References Cited

U.S. PATENT DOCUMENTS

| | | | |
|---|---|---|---|
| 2,745,479 | 5/1956 | Young | 432/225 X |
| 2,886,336 | 5/1959 | Reynard | 65/155 |
| 4,433,970 | 2/1984 | Spainhour | 432/225 X |
| 4,561,874 | 12/1985 | Colacello et al. | 65/36 |
| 4,618,355 | 10/1986 | Otto et al. | 65/271 X |

FOREIGN PATENT DOCUMENTS 54-39568 3/1979 Japan .

OTHER PUBLICATIONS

*RCA Technical Notes—TN No.* 1299, RCA/Princeton, N.J., Apr. 6, 1982.

*Primary Examiner*—Kenneth J. Ramsey

*Attorney, Agent, or Firm*—Cushman, Darby & Cushman

[57] ABSTRACT

In a method for manufacturing a cathode ray tube, a bulb is held by a first holding mechanism. An electron gun is inserted and held in a neck portion of the bulb by a second holding mechanism. Then, the neck portion and a stem of the electron gun are welded by a welding unit. The unit includes an annular burner having an inner surface with a plurality of burner holes formed in substantially the entire area along a circumferential direction thereof. The annular burner is constructed by two burner members which can be separated in a radial direction. The burner is positioned by an opening/closing mechanism and a reciprocating mechanism such that the inner peripheral surface of the burner is coaxially located outside the neck portion and opposes the stem of the electron gun. Thereafter, the neck portion is heated by flames injected from the burner holes, and then the burner is reciprocally rotated about its axis through a predetermined angle.

11 Claims, 6 Drawing Figures

METHOD AND APPARATUS FOR MANUFACTURING CATHODE RAY TUBE

BACKGROUND OF THE INVENTION

The present invention relates to a method and apparatus for manufacturing a cathode ray tube, wherein a neck portion of a bulb of the cathode ray tube and a stem of an electron gun inserted in the neck portion are welded.

Steps of manufacturing a cathode ray tube include a step of sealing a cathode ray tube bulb. In the sealing step, an electron gun is inserted at a predetermined position in a neck portion of the bulb with a high positional precision, and then a stem of the electron gun and the neck portion are externally heated by a burner and integrally welded.

As a method for practicing this welding, the following method is known. More specifically, an electron gun is inserted in a neck portion of a bulb. Then, the entire assembly is rotated about the neck portion, and the neck portion is heated by the flames of burners provided on two sides of the neck portion, thereby welding the neck portion and the stem of the electron gun.

According to another known welding method, an electron gun is inserted in a neck portion of a bulb, burners provided on two sides of the neck portion are rotated along the outer surface of the neck portion, and the neck portion is heated by the flames of the burners, thereby welding the neck portion and the stem of the electron gun.

In the former method, however, since the bulb and the electron gun are rotated, an oscillation caused by the rotation occurs in the bulb. This oscillation may cause off-centering of the electron gun and the neck portion of the bulb, or the electron gun may contact and damage the phosphor layer of the bulb. As a result, sealing precision of the bulb is degraded.

In the latter method, since a plurality of burners are rotated, problems are caused by oscillation as in the former method, and a complex mechanism is required for rotating the burners.

SUMMARY OF THE INVENTION

The present invention has been made in view of the above situation, and has as its object to provide a highly efficient method and apparatus for manufacturing a cathode ray tube, wherein a neck portion of a bulb and a stem of an electron gun can be welded with a high sealing precision.

In order to achieve the above object, a manufacturing method according to the present invention comprises the steps of: holding a cathode ray tube bulb; inserting and holding an electron gun at a predetermined position in a neck portion of the bulb; arranging an annular burner, which has an inner peripheral surface with a plurality of burner holes formed in substantially the entire area along a circumferential direction thereof, such that the inner peripheral surface is coaxially located outside the neck portion and opposes a stem of the electron gun, the burner being formed to be capable of being divided into halves in a radial direction; injecting flames from the burner holes toward the neck portion; and reciprocally rotating the annular burner about an axis thereof through a predetermined angle.

A manufacturing apparatus according to the present invention comprises: a first holding means for holding a cathode ray tube bulb; a second holding means for holding an electron gun in a state wherein the electron gun is inserted at a predetermined position in the bulb; and a welding unit for welding the neck portion and the stem, the welding unit including an annular burner having an inner peripheral surface with a plurality of burner holes formed in substantially the entire area along a circumferential direction thereof, the annular burner having two burner members which can be separated in a radial direction, an opening/closing mechanism for moving the burner members to a closed position where the burner members constitute the annular burner, and an open position where the burner members are separated from each other, a reciprocating mechanism for moving the burner to a heating position where the inner peripheral surface of the burner is coaxially positioned outside the neck portion while opposing the stem, and a non-heating position where the burner is separated from the neck portion, and a rotating mechanism for reciprocally rotating the burner about an axis thereof through a predetermined angle.

BRIEF DESCRIPTION OF THE DRAWINGS

FIGS. 1 to 6 show a manufacturing apparatus according to an embodiment of the present invention, in which FIG. 1 is a perspective view schematically showing an overall structure of the apparatus;

FIG. 2 is a plan view of a welding unit;

FIG. 3 is a side view of the welding unit;

FIG. 4 is a partially exploded perspective view of an annular burner;

FIG. 5 is a plan view of a rotating mechanism; and

FIG. 6 is an enlarged sectional view of a welded portion.

DETAILED DESCRIPTION OF THE PREFERRED EMBODIMENT

An embodiment of the present will be described in detail with reference to the accompanying drawings.

A manufacturing apparatus according to the present invention will first be described.

Figure 1:
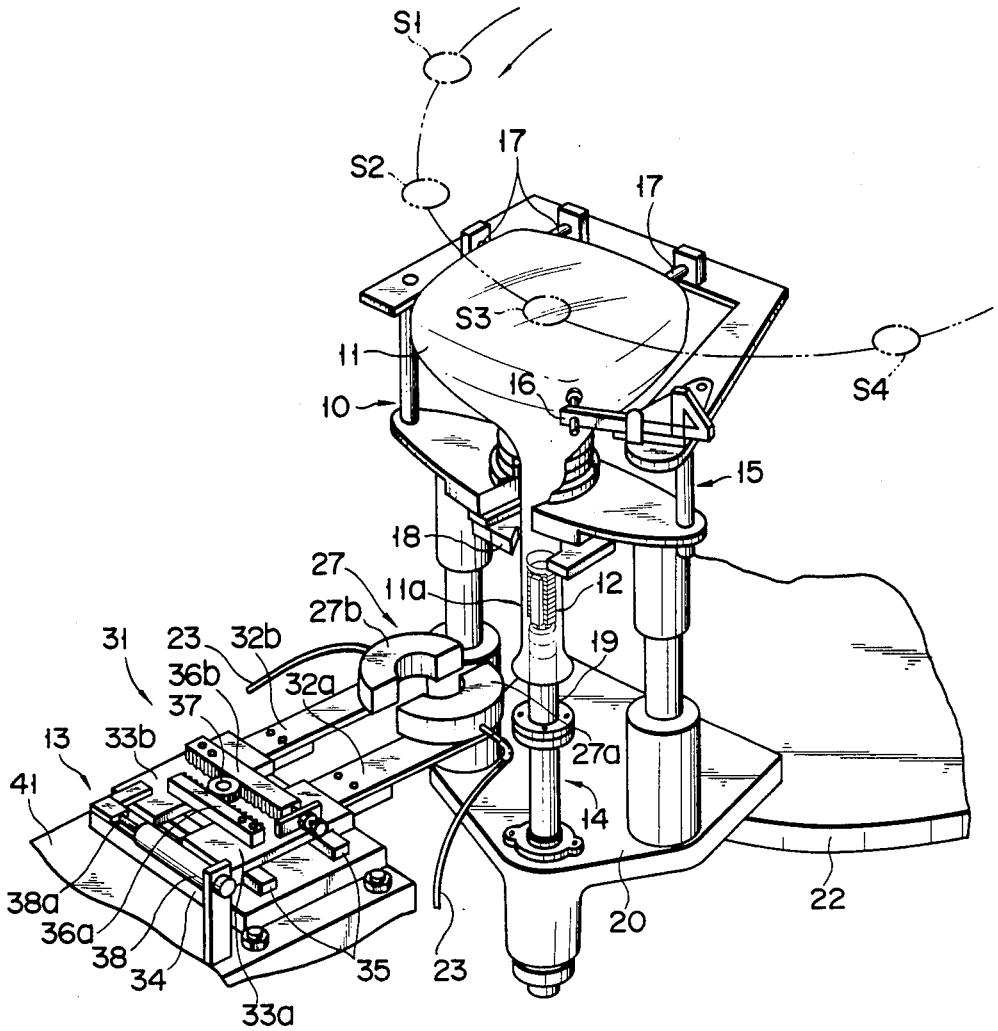

As shown in FIG. 1, the manufacturing apparatus comprises bulb holding mechanism 10 holding bulb 11, electron gun holding mechanism 14 holding electron gun 12, and welding unit 13, for welding the stem of electron gun 12 and neck portion 11*a* of bulb 11.

Holding mechanism 10 has reception table 15 supported on support table 20. Bulb 11, placed on reception table 15, is urged against bulb stopper 17 of table 15 by press member 16 and is held in the illustrated position. Neck portion 11*a* of bulb 11 is held at a predetermined position by neck chuck 18 provided on reception table 15. Holding mechanism 14 has mount holder 19 for holding electron gun 12. Holder 19 is provided on support table 20 to be vertically movable. When holder 19 is moved upward, electron gun 12 is inserted in neck portion 11*a* of bulb 11 with a high positioning precision, and is held at this position.

Support table 20 is mounted on a rotary table 20. Table 20 rotates for a predetermined distance intermittently at a predetermined period, e.g., 25 seconds. Upon this movement, bulb 11 and electron gun 12 are intermittently conveyed from stage S1 to a next stage while they are held at predetermined positions with respect to each other. Other support tables (not shown), having the same construction as table 20, are mounted on rotary table 22, spaced from one another at a constant interval.

As shown in FIGS. 1 to 4, welding unit 13 has annular burner 27 which is capable of being split into halves and thermally welds neck portion 11*a* of bulb 11 and stem 12*a* of electron gun 12, reciprocating mechanism 30 for moving burner 27 toward and away from neck portion 11*a*, opening/closing mechanism 31 for opening/closing burner 27, and rotating mechanism 46 for rotating burner 27 through a predetermined angle.

Figure 4:
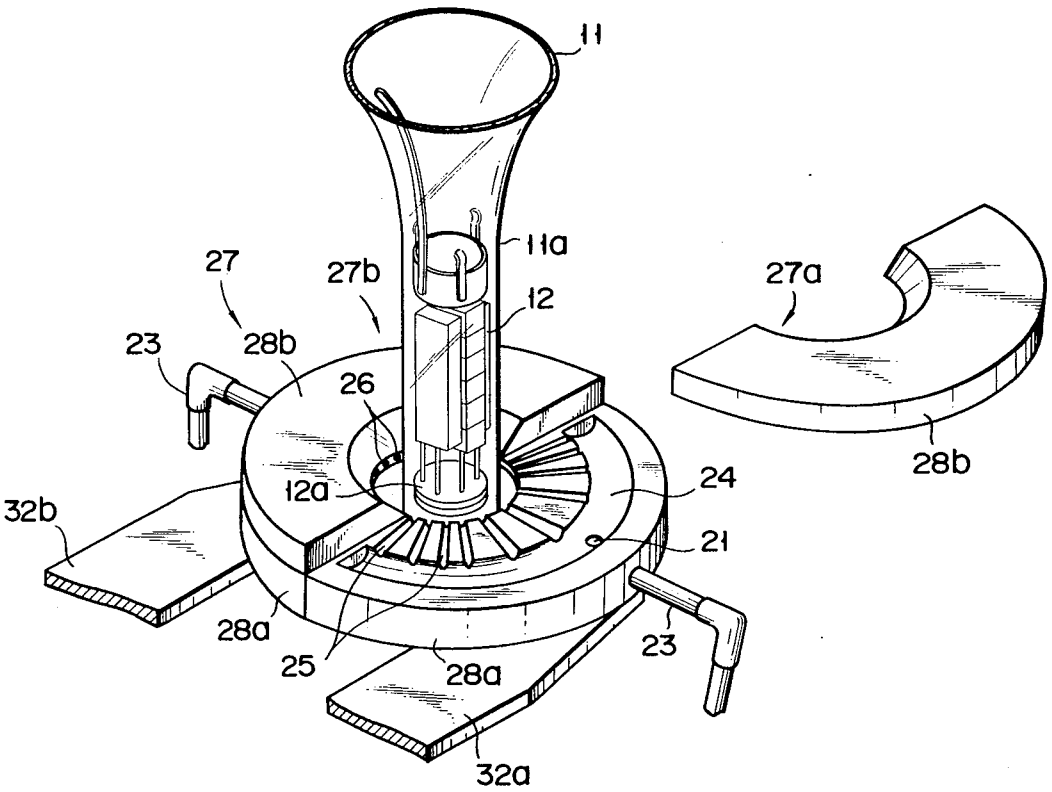

As shown in detail in FIG. 4, burner 27 has two semi-annular burner members 27*a* and 27*b* that can be split into halves in the radial direction. Each of members 27*a* and 27*b* consists of main body 28*a* and cover 28*b* fixed on the upper surface of main body 28*a*. Gas supply groove 24 extends on substantially the entire area on the upper surface of main body 28*a* along the circumferential direction. A plurality of gas discharge grooves 25 extend from supply groove 24 to the inner surface of main body 28*a* in the radial direction. Grooves 25 are formed to be equally spaced apart from one another along the circumferential direction of main body 28*a*. An end of each groove 25, opening in the inner peripheral surface of main body 28*a*, defines burner hole 26. Groove 24 is connected to a gas supply source (not shown) through inlet hole 21, formed in main body 28*a*, and supply pipe 23, connected thereto. In this manner, burner 27 has burner holes 26 on substantially its entire area of the inner peripheral surface.

Opening/closing mechanism 30, for opening/closing burner 27 having the above arrangement, i.e., separating/connecting burner members 27*a* and 27*b*, includes a pair of parallel arms 32*a* and 32*b*, as shown in FIGS. 1 to 4. Burner members 27*a* and 27*b* are fixed on distal ends of arms 32*a* and 32*b*, respectively. The proximal ends of arms 32*a* and 32*b* are fixed to movable tables 33*a* and 33*b*, respectively. Tables 33*a* and 33*b* are placed on guide table 34. A pair of guide rails 35 are provided on table 34 and extend in a direction perpendicular to arms 32*a* and 32*b*. Tables 33*a* and 33*b* are arranged to be movable along guide rails 35. Racks 36*a* and 36*b* are fixed on tables 33*a* and 33*b*, respectively, and extend parallel to each other and in a direction perpendicular to arms 32*a* and 32*b*. Pinion gear 37 is rotatably supported at substantially a central position of guide table 34. Pinion gear 37 is positioned between, and meshes with, racks 36*a* and 36*b*. Therefore, racks 36*a* and 36*b* are moved synchronously in opposing directions. Guide table 34 is fixed on slide base 41. Air cylinder 38 is mounted on slide base 41 to be parallel to racks 36*a* and 36*b*. The distal end of piston rod 38*a* of air cylinder 38 is connected to movable table 36*b*. Therefore, when air cylinder 38 is actuated, movable tables 33*a* and 33*b* are moved in opposite directions in order to be close to or separate from each other, thereby opening/closing burner 37.

Reciprocating mechanism 30 will now be described. Mechanism 30 includes slide base 41, supporting guide table 34 and air cylinder 38. Slide base 41 is placed on guide table 42, to be movable along an extending direction of arms 32*a* and 32*b*. In other words, a pair of guide rails 43 are fixed on table 42 to extend along the extending direction of arms 32*a* and 32*b*. Slide base 41 is placed on guide rails 43. Air cylinder 44 is also mounted on guide table 42, extending parallel to guide rails 43. The distal end of piston rod 44*a* of air cylinder 44 is connected to slide base 41. By means of air cylinder 44, slide base 41 is moved between an advanced position, where annular burner 27 is positioned close to and outside neck portion 11*a* of bulb 11, and a retreated position, where burner 27 is positioned away from neck portion 11*a*.

Figure 2:
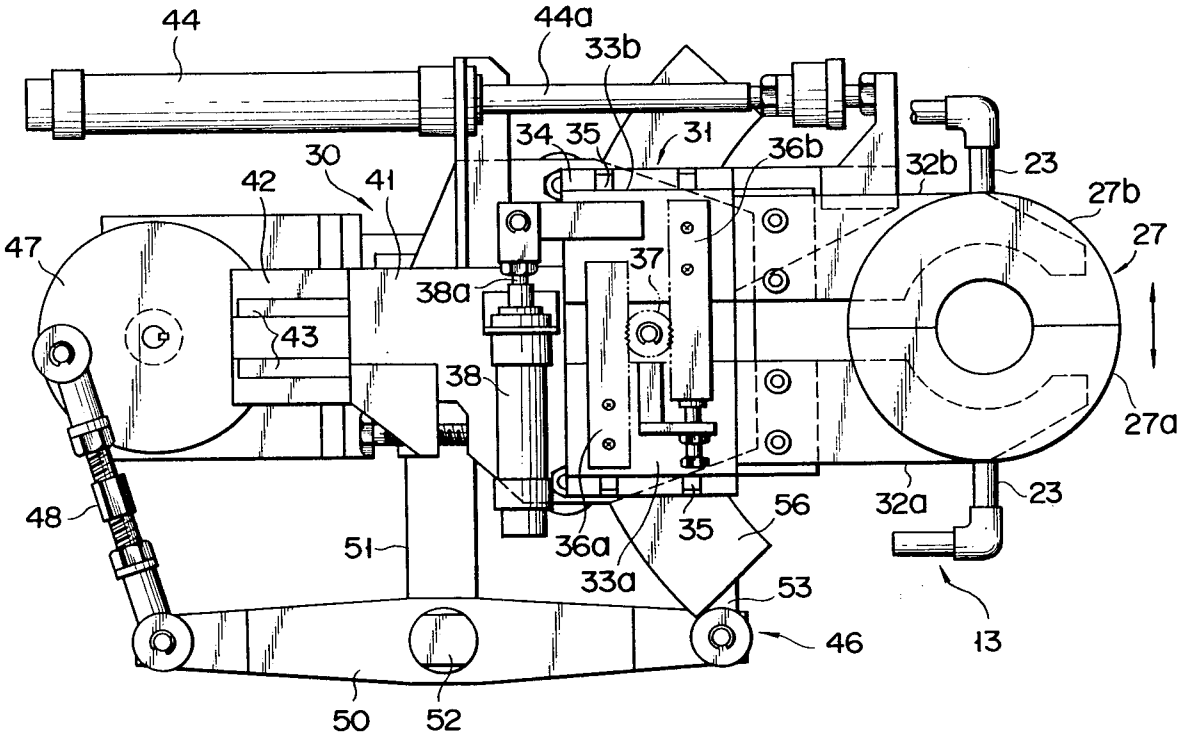
Figure 3:
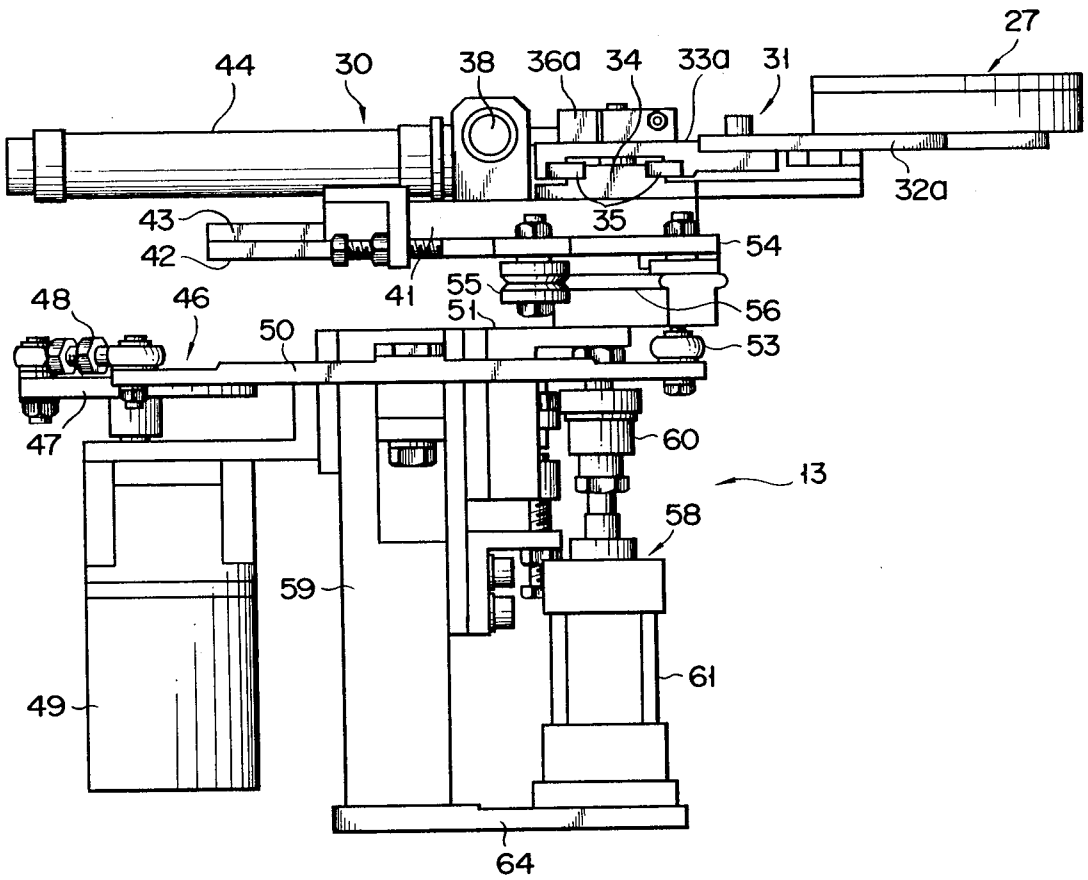
Figure 5:
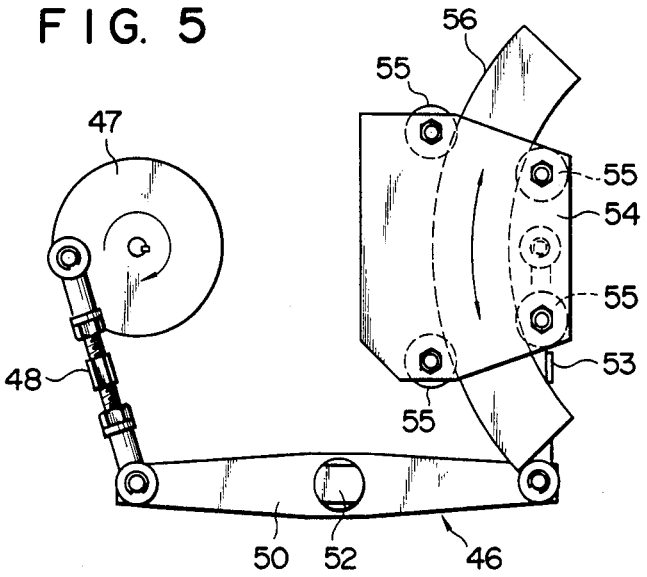

Rotating mechanism 46, for reciprocally rotating burner 27 through a predetermined angle, has drive disc 47 rotatably mounted on elevating frame 51, as shown in FIGS. 2, 3, and 5. Disc 47 is rotated by motor 49 fixed to frame 51. One end of connecting rod 48 is pivotally coupled to the upper peripheral portion of disc 47. The other end of rod 48 is pivotally coupled to one end of drive arm 50. An intermediate portion of arm 50 is pivotally supported by frame 51 by support shaft 52. Thus, when disc 47 is rotated by motor 49, drive arm 50 oscillates about support shaft 52 on a horizontal plane in a see-saw manner. One end of connecting rod 53 is pivotally coupled to the other end of arm 50. The other end of rod 53 is pivotally coupled to support plate 54. Plate 54 supports reciprocating mechanism 30 and opening/closing mechanism 31 thereon. Four guide rollers 55 are rotatably mounted on the lower surface of support plate 54 and are engaged with arcuate guide plate 56 fixed on frame 51. Thus, when drive arm 50 is oscillated in a see-saw manner, support plate 54 reciprocates on an arcuate path along plate 56.

Guide plate 56 is arranged such that its center of curvature coincides with the center of annular burner 27. Therefore, when support plate 54 reciprocates along plate 56, burner 27, which is mounted on plate 54 through opening/closing mechanism 31, reciprocally rotates about its axis through a rotational angle corresponding to the reciprocal movement of plate 54. The rotational angle of burner 27 is set to about $\pm 20°$, and burner 27 is set to perform one reciprocal movement within about three seconds.

Welding unit 13 has elevating mechanism 58 for vertically moving burner 27 through elevating frame 51 along the axial direction of burner 27. Frame 51 is supported by support column 59 by a slide mechanism (not shown) so as to be vertically movable. Column 59 is fixed on base 64. Cylinder 61, with an autoswitch, is arranged on base 64 to extend in the vertical direction, and is connected to frame 51 through floating joint 60. Upon reciprocal movement of cylinder 61, elevating frame 51, rotating, opening/closing, and reciprocating mechanisms 46, 31, and 30, and annular burner 27, that are supported on frame 51, are integrally moved in the vertical direction.

An operation of the manufacturing apparatus having the above arrangement will be described together with its manufacturing method.

As shown in FIG. 1, bulb 11 is first held by holding mechanism 10, and electron gun 12 is inserted and held at a predetermined position in neck portion 11*a* of bulb 11 by holding mechanism 14. In this state, annular burner 27 of welding unit 13 is at the open and retreated position where its burner members 27*a* and 27*b* are separated from each other and are spaced apart from neck portion 11*a*.

Figure 6:
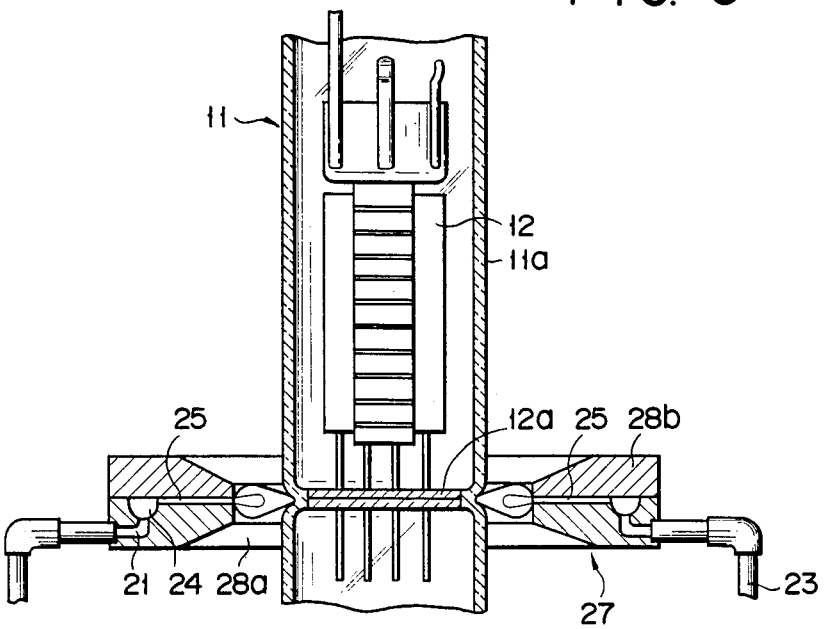

Subsequently, burner 27 is moved to the advanced position by reciprocating mechanism 30 and is positioned close to and outside neck portion 11*a*. Burner 27 is then moved to the closed position by opening/closing mechanism 27 where its burner members 27*a* and 27*b* contact each other to form an annular shape. Accordingly, the inner peripheral surface of burner 27 coaxially surrounds neck portion 11*a*. Thereafter, burner 27 is moved by elevating mechanism 58 to a position where its inner peripheral surface opposes stem 12*a* of electron gun 12. Therefore, burner holes 26 formed in the inner peripheral surface of burner 27 oppose the outer surface of neck portion 11*a* along substantially 360°, as shown in FIGS. 4 and 6. In this state, a mixture of gas and oxygen is injected from burner holes 26 and ignited. Subsequently, rotating mechanism 46 reciprocally rotates burner 27 about the axis thereof, i.e., an axis of neck portion 11*a*, through a predetermined angle. As a result, neck portion 11*a* and stem 12*a* are entirely heated by the flames of burner 27.

After neck portion 11*a* is heated for a predetermined period of time, e.g., for 25 seconds in the above manner, burner 27 is moved to the open position and then to the retreated position. Thereafter, bulb 11 and electron gun 12 are moved to a next stage (from S3 to S4) by rotary table 20 while they are supported by holding mechanisms 14 and 15. Bulb 11 and electron gun 12 are heated for 25 seconds by another welding unit in the same manner as described above, and are conveyed to following stages. When the total heating time reaches about 8 minutes, neck portion 11*a* and stem 12*a* are completely welded, as shown in FIG. 6. Therefore, a welded bulb-electron gun assembly is produced every 25 seconds in the welding step, and is supplied to following manufacturing steps.

According to the manufacturing apparatus having the above arrangement and the manufacturing method, since annular burner 27 is used, flames can be directed to the neck portion from all directions, i.e., substantially the entire circumference around the outer peripheral surface of neck portion 11*a*. Since the entire surface of neck portion 11*a* can be heated uniformly, neither bulb 11 nor electron gun 12 need to be rotated. Burner 27 need not be rotated, either. Thus, off-centering of electron gun 12 or the scratching of the phosphor layer of bulb 11, which is caused by oscillation due to rotation transmitted to bulb 11, can be prevented, thereby improving the sealing precision. Since annular burner 27 is reciprocally rotated within a predetermined angle, a slight temperature decrease occurring between adjacent burner holes 26 or at contact portions of burner members 27*a* and 27*b*, or that caused by clogging of burner holes 26 can be prevented. As a result, the entire surface of neck portion 11*a* can be heated to a uniform temperature, and neck portion 11*a* and stem 12*a* of electron gun 12 can be welded satisfactorily.

Furthermore, since annular burner 27 can be split into halves, it can easily be mounted outside neck portion 11*a* and separated therefrom, thus improving the manufacturing efficiency. Thus, the present invention is suitable for mass-production.

It must be noted that the present invention is not limited to the above embodiment, and various changes and modifications can be made within the spirit and scope of the invention.

As annular burners, those which use gas and oxygen as a fuel and those which use gas and air as a fuel are also known. When gas and oxygen are used as a fuel, the burner is heated to a high temperature. In the above embodiment therefore, it is preferable that a water-cooling pipe be provided to cool inside the burner main body. In the above embodiment, the burner grooves of the annular burner extend in a horizontal direction. In this case, the flame heats the outer surface of the neck portion and then can extend upward, inevitably heating the other portion of bulb 11 and possibly damage bulb 11. In order to prevent this, the burner grooves can be formed to be inclined downward.

In the above embodiment, elevating mechanism 58 vertically reciprocates elevating frame 51 by air cylinder 61. However, the present invention is not limited to this. A disc having a horizontal rotating axis, and a motor for rotating the disc can be provided, and the peripheral portion of the disc can be coupled to frame 51 by a link rod. In this case, elevating frame 51 is vertically reciprocated by rotation of the disc.

The drive means of each mechanism is not limited to an air cylinder, but can be other drive means such as a motor.

What is claimed is:

1. A cathode ray tube manufacturing method for welding a neck portion of a cathode ray tube bulb and a stem of an electron gun inserted in the neck portion, comprising the steps of:

holding said cathode ray tube bulb;

inserting and holding said electron gun at a predetermined position in the neck portion;

positioning an annular burner, which has an inner peripheral surface with a plurality of burner holes formed in substantially the entire area along a circumferential direction thereof, such that the inner peripheral surface is coaxially located outside the neck portion and opposes the stem of the electron gun, said burner being formed to be capable of being divided into halves in a radial direction;

injecting flames from the burner holes toward the neck portion; and reciprocally rotating the annular burner about its axis through a predetermined angle.

2. A method according to claim 1, wherein said positioning step includes the processes of: arranging the annular burner to a position separated from the neck portion, dividing the annular burner into halves, arranging divided burner halves outside the neck portion, and joining the burner halves to form an annular shape.

3. A method according to claim 2, wherein said positioning step includes a process of moving the annular burner along an axial direction of the burner to a position where the burner opposes the stem of the electron gun.

4. A method according to claim 1, wherein said rotating step includes a process of rotating the annular burner through an angle of about ±20°.

5. A manufacturing apparatus for welding a neck portion of a cathode ray tube bulb and a stem of an electron gun inserted in the neck portion, comprising:

first holding means for holding the cathode ray tube bulb;

second holding means for holding the electron gun in a state wherein the electron gun is inserted at a predetermined position in the bulb; and a welding unit for welding the neck portion and the stem, said welding unit including an annular burner having an inner peripheral surface with a plurality of burner holes formed in substantially the entire area along a circumferential direction thereof, said annular burner having two burner members that can be separated along a radial direction, an opening/closing mechanism for moving said burner members to a closed position where the burner members constitute the annular burner, and an open position where the burner members are separated from each other, a reciprocating mechanism for moving the burner to a heating position where the inner peripheral surface of the burner is coaxially positioned outside the neck portion while opposing the stem, and a non-heating position where the burner is separated from the neck portion, and a rotating mechanism for reciprocally rotating the burner about its axis through a predetermined angle.

6. An apparatus according to claim 5, wherein each of said burner members has substantially a semicircular form.

7. An apparatus according to claim 6, wherein said opening/closing mechanism includes a guide table; a pair of parallel arms each having a proximal end supported on the guide table to be movable along a direction perpendicular to the arms, and a distal end supporting a corresponding one of the burner members; and drive means for driving the arms in directions to move close to each other and separate from each other.

8. An apparatus according to claim 7, wherein said drive means includes a pair of racks, fixed to the arms respectively, and provided so as to be parallel to each other and along the moving direction of the arms; a pinion gear rotatably mounted on the guide table and meshed with both of the racks; and an air cylinder, coupled to one of the arms, for driving the same.

9. An apparatus according to claim 5, wherein said rotating mechanism includes a support frame; an arcuate guide member fixed on the support frame and having a center of curvature coinciding with the axis of the annular burner; a support member which supports the opening/closing mechanism and reciprocating mechanism and is supported on the guide member to be movable therealong; and drive means for reciprocally moving the support member along the guide member.

10. An apparatus according to claim 9, wherein said drive means includes a drive arm having a fulcrum pivotally supported by the support frame and supported to be capable of oscillating within a plane perpendicular to the axis of the annular burner, said drive arm having two ends positioned on two sides of said fulcrum; a rotating disc supported by the support frame to be rotatable within a plane perpendicular to the axis of the annular burner; a motor for driving the rotating disc; a first connecting rod pivotally connected to a peripheral portion of the rotating disc and to one end of the drive arm; and a second connecting rod having one end pivotally connected to the other end of the drive arm and the other end pivotally connected to the support member.

11. An apparatus according to claim 5, which further comprises an elevating mechanism for moving the annular burner, the rotating mechanism, and the reciprocating mechanism along the axial direction of the burner.

* * * * *